US005413824A

United States Patent [19]

Van Erden

[11] Patent Number: 5,413,824

[45] Date of Patent: May 9, 1995

[54] COLLAPSIBLE AND EXPANDABLE ROLL RISER

[75] Inventor: Donald L. Van Erden, Wildwood, Ill.

[73] Assignee: Shippers Paper Products Company, Glenview, Ill.

[21] Appl. No.: 193,454

[22] Filed: Feb. 8, 1994

[51] Int. Cl.[6] ..... B32B 3/04; B32B 3/08; B32B 3/12

[52] U.S. Cl. ..... 428/12; 428/116; 428/122; 410/121; 410/154; 108/51.3; 206/593

[58] Field of Search ..... 428/12, 116, 122; 410/121, 154; 206/593, 814; 108/51.3

[56] References Cited

U.S. PATENT DOCUMENTS

| | | | |
|---|---|---|---|
| 3,079,876 | 3/1963 | Doane | 108/56 |
| 3,079,877 | 3/1963 | Doane | 108/56 |
| 4,494,897 | 1/1985 | Rogers | 410/154 |
| B1 4,494,897 | 3/1993 | Rogers | 410/154 |
| 4,865,889 | 9/1989 | Boyse | 428/12 |

OTHER PUBLICATIONS

Brochure "Capabilities & Products" by Shippers Paper Products Co. Dec. 1988.

*Primary Examiner*—Alexander S. Thomas
*Attorney, Agent, or Firm*—Schwartz & Weinrieb

[57] ABSTRACT

A roll riser for use, such as in staggering paper rolls, during shipment generally includes a rigid sheet and a core attached by its ends to the sheet along the length of the sheet. The core is collapsible and expandable so as to transform the roll riser from a collapsed configuration to an expanded configuration. First and second end portions of the sheet are folded against a side of the core around fold lines, and lie generally adjacent to the core to cause the roll riser to remain in an expanded configuration.

15 Claims, 2 Drawing Sheets

FIG.1
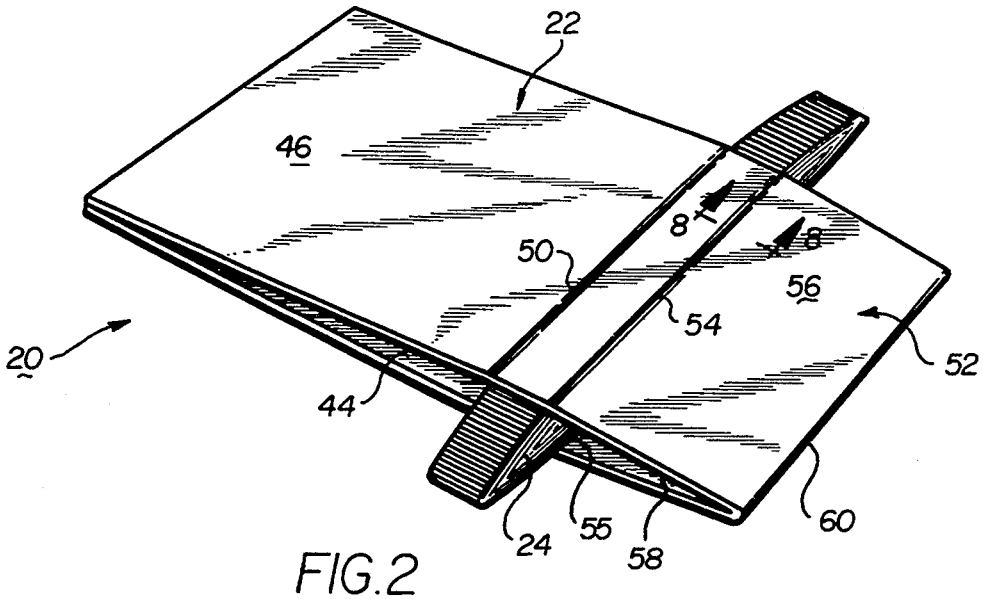
FIG.2
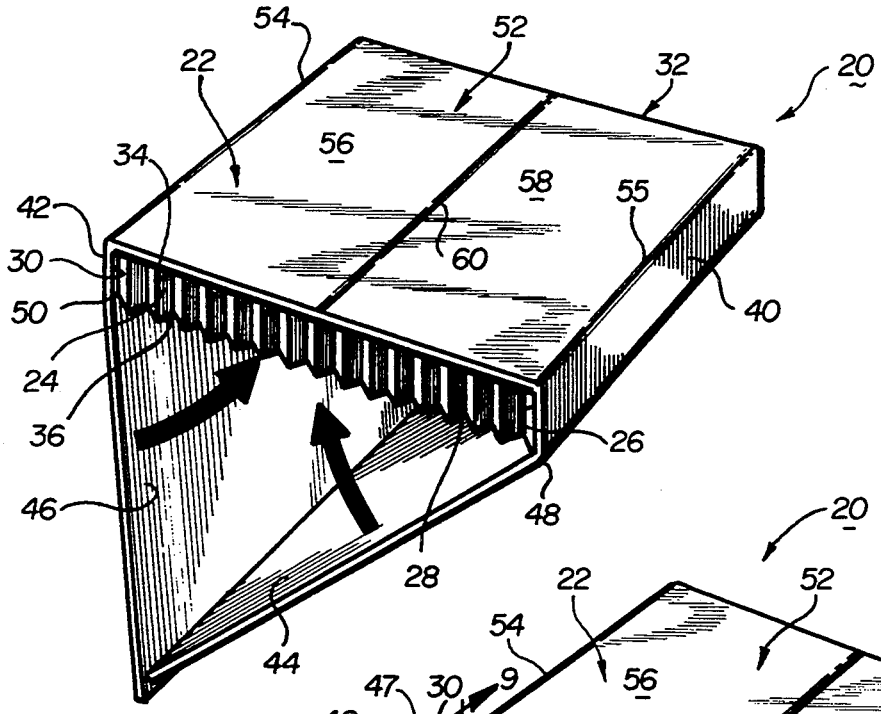
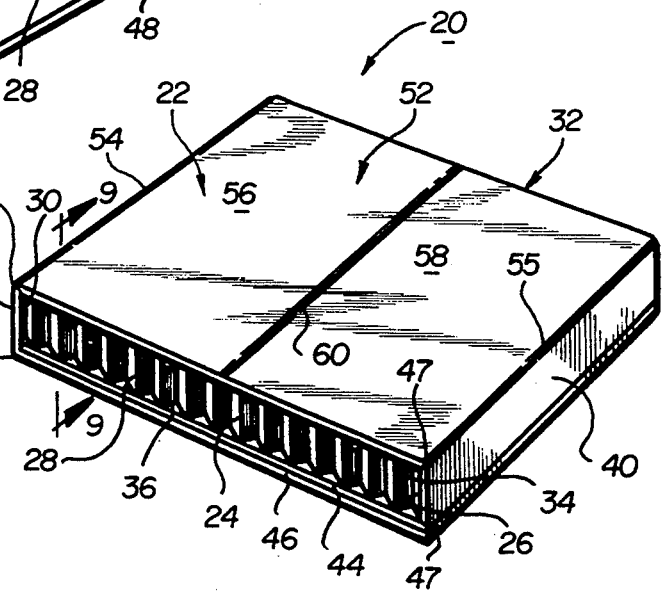
FIG.3

COLLAPSIBLE AND EXPANDABLE ROLL RISER

FIELD OF THE INVENTION

This invention is generally directed to a device or roll riser which may be used to stagger paper rolls during shipment. More particularly, the invention contemplates an open-cell roll riser which can collapse for shipment to the user or for storage while occupying a relatively small amount of space and then expanded by the user for use.

BACKGROUND OF THE INVENTION

The use of roll risers is well-known in the art. For example, U.S. Pat. No. 4,865,889 to Boyse discloses an open-celled roll riser that is comprised of a honeycomb core surrounded by deck sheets. The ends of the deck sheets are secured to the ends of the honeycomb core and include integrally formed score indentations in the deck sheet along the edges of the core and along the midpoint of the deck sheets. The roll riser collapses around the fold lines and the honeycomb core collapses therewithin. The roll riser may be transformed from a collapsed configuration to an expanded configuration by pulling the opposing ends of the deck sheets which are secured to the core away from each other until the sides of the deck sheets generally abut the core.

While this type of roll riser has worked effectively in prior applications, it tends to collapse due to the natural tendencies of the honeycomb core to collapse and of the score indentations which tend to expand the deck sheets of the roll riser outwardly. The present invention is intended to overcome or minimize problems found in prior art roll risers, as well as to present several other improvements.

OBJECTS OF THE INVENTION

A general object of the present invention is to provide a novel device or roll riser suitable for various uses, such as to stagger paper rolls during shipment.

An object of the present invention is to provide a novel roll riser which will remain in an expanded configuration.

Another object of the present invention is to provide a novel roll riser which has an open-cell core which can collapse for shipment to the user or for storage while occupying a relatively small amount of space and then be expanded by a user for use, and which will remain in either the expanded conditions until manually manipulated by the user.

A further object of the present invention to provide a novel roll riser that is lightweight, rigid and strong, and reusable.

A specific object of the present invention is to provide a roll riser which can be assembled with ease by a user with no specialized training.

SUMMARY OF THE INVENTION

Briefly, and in accordance with the foregoing, the present invention comprises a roll riser which may be used for staggering paper rolls during shipment. The roll riser generally includes a rigid sheet and an open-celled core. The sheet is of a predetermined length and has first and second end portions. The core is attached to the sheet along the length of the sheet. The core is collapsible and expandable so as to transform the roll riser from a collapsed configuration to an expanded configuration.

The first and second end portions of the sheet are folded against a side of the core around fold lines, and lie generally adjacent to the core so as to cause the roll riser to remain in an expanded configuration. In a first embodiment, when the core is expanded, the first end portion extends along substantially the entire length of the core and the second end portion folds over the first end portion and extends along substantially the entire length of the core. In a second embodiment, the first and second end portions extend to approximately the midpoint of the core when the core is expanded. In a third embodiment, when the core is expanded, the first end portion extends along substantially the entire length of the core and the second end portion folds over the first end portion along a fold line and extends to an intermediate point of the core.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements throughout the several views, and in which:

FIG. 1 is a perspective view of a roll riser in a collapsed configuration, which incorporates the features of a first embodiment of the invention;

FIG. 2 is a perspective view of the roll riser of FIG. 1 shown in a partially assembled configuration;

FIG. 3 is a perspective view of the roll riser of FIG. 1 shown fully assembled;

DETAILED DESCRIPTION OF THE ILLUSTRATED EMBODIMENTS

Figure 4:
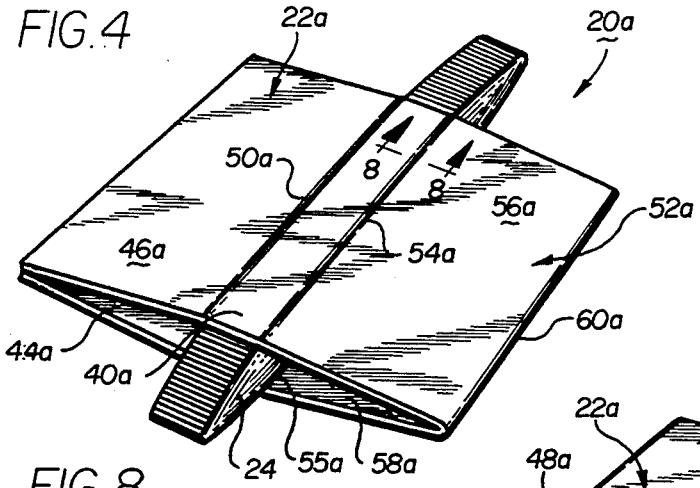
FIG. 4 is a perspective view of a roll riser in a collapsed configuration, which incorporates the features of a second embodiment of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein. Three specific embodiments are disclosed herein. Like elements are designated by like reference numerals. For clarity, specific elements which relate to the second embodiment are designated with an "a". In a like manner, specific elements which relate to the third embodiment are designated with a "b".

The device or roll riser 20, 20*a*, 20*b* which incorporates features of the present invention is susceptible of various uses and is particularly adapted to be used to stagger paper rolls in a known manner (not shown) during shipment. The roll riser 20, 20*a*, 20*b* may be used in a variety of shipping applications, such as within a truck trailer, a ship or an airplane cargo bay. The roll riser 20, 20*a*, 20*b* is of a lightweight construction and may be of a variety of sizes, depending on the use.

The roll riser 20, 20*a*, 20*b* can be collapsed for shipment to the user or for storage and occupies a relatively small amount of space, and then expanded by the user for use in staggering paper rolls during shipment. Due to a novel feature of the roll riser 20, 20*a*, 20*b* of the present invention, the roll riser 20, 20*a*, 20*b* maintains an expanded configuration as described in detail hereinbelow.

When in an expanded configuration, the roll riser 20, 20*a*, 20*b* is of a sandwich-type construction so as to increase the strength of the device or roll riser 20, 20*a*, 20*b*. The sandwich-type construction helps to prevent the roll riser 20, 20*a*, 20*b* from collapsing under the load of the paper rolls during shipping and is formed by a generally rigid, deck sheet 22, 22*a*, 22*b* which surrounds a reinforcing and strengthening core 24.

The core 24 is preferably of an open-celled configuration having ends 26, 28, 30, 32 and sides 34, 36. The core 24 is made of a suitable material, preferably heavy paper. Open-celled constructions are well known in the art, and, as such, will not be described in detail herein. One such core construction is disclosed in U.S. Pat. No. 4,865,889 to Boyse, whose disclosure is herein incorporated by reference.

Figure 5:
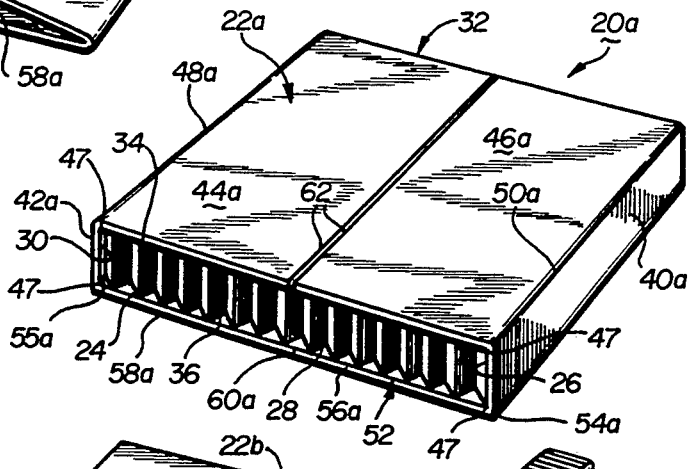
FIG. 5 is a perspective view of the roll riser of FIG. 4 shown fully assembled.
Figure 6:
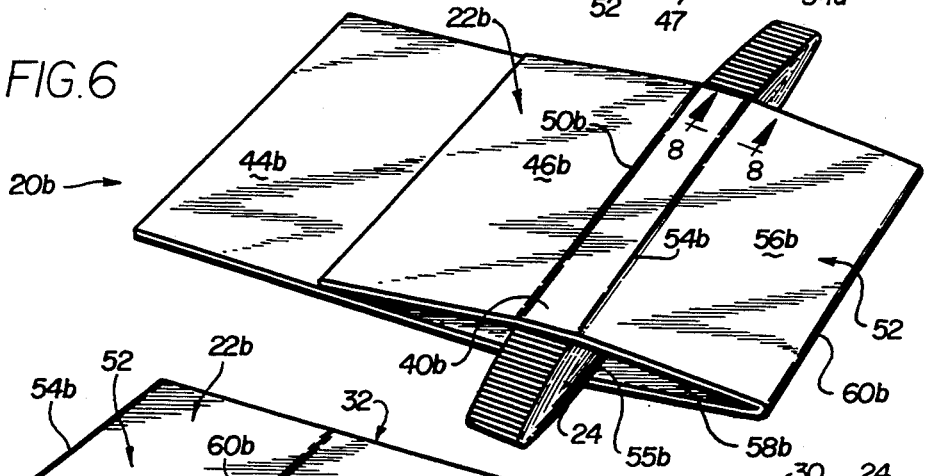
FIG. 6 is a perspective view of a roll riser in a collapsed configuration, which incorporates the features of a third embodiment of the invention.
Figure 7:
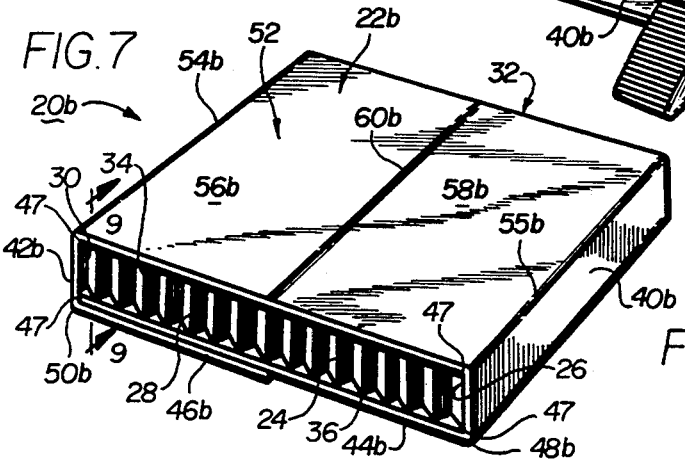
FIG. 7 is a perspective view of the roll riser of FIG. 6 shown fully assembled.

Briefly, the core 24 can be made by stacking a series of core sheets, which are generally hexagonally-shaped, and gluing the hexagonally-shaped core sheets to one another at appropriate points to create an open-celled "honeycomb-like" core structure when the roll riser 20, 20*a*, 20*b* is in an expanded configuration. When the device or roll riser 20, 20*a*, 20*b* is in its collapsed reduced volume configuration, as shown in FIGS. 1, 4 and 6, the core 24 is generally flat. Thus, the roll riser 20, 20*a*, 20*b* does not occupy a large amount of space when it is being shipped to a user or stored. Furthermore, since the roll riser 20, 20*a*, 20*b* is generally flat, multiple roll risers may be stacked on top of each other for shipment to the user or for storage. When the roll riser 20, 20*a*, 20*b* is expanded to its increased volume configuration, as shown in FIGS. 3, 5 and 7, the honeycomb core 24 is expanded to its open-celled configuration. It is to be understood that it is within the scope of the present invention that the core 24 may be of another form so long as the core 24 is expandable and collapsible.

The deck sheet 22, 22*a*, 22*b* is made of a suitable, relatively rigid material, such as corrugated cardboard. The deck sheet 22, 22*a*, 22*b* is of a predetermined length and has portions 40, 40*a*, 40*b*, and 42, 42*a*, 42*b* which are attached to the ends 26, 30 of the core 24, respectively, at predetermined positions along the length of the deck sheet 22, 22*a*, 22*b*. The portions 40, 42 are attached to the ends 26, 30 of the core 24 by suitable means, such as a layer of adhesive.

Figure 8:
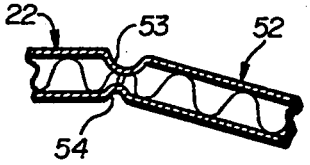
FIG. 8 is a cross-sectional view of a score line of the roll risers of FIGS. 1, 4 and 6 taken along line 8—8 of either one of the noted FIGURES.

A first end portion 44, 44*a*, 44*b* and a second end portion 46, 46*a*, 46*b* of the deck sheet 22, 22*a*, 22*b* which will be described in detail herein, extend outwardly from the portions 40, 42 of the deck sheet 22, 22*a*, 22*b* which are attached to the ends 26, 30 of the core 24 and along one side 36 of the core 24. The end portions 44, 44*a*, 44*b* and 46, 46*a*, 46*b* can be folded generally around the edges 47 of the core 24 along fold lines 48, 48*a*, 48*b* and 50, 50*a*, 50*b*, respectively, for reasons more fully described herein. The fold lines 48, 48*a*, 48*b* and 50, 50*a*, 50*b* are preferably formed by a scoring bead or an integrally formed score indentation 53, as shown in FIG. 8, which extends along the width of the deck sheet 22, 22*a*, 22*b*. The score indentations 48, 48*a*, 48*b* and 50, 50*a*, 50*b* are applied by any well-known method, such as an automatic roller or a manual device, and is intended not to pierce, cut, or otherwise weaken the material.

On the opposite side 34 of the core 24, the deck sheet 22, 22*a*, 22*b* has a continuous side portion 52, 52*a*, 52*b* which extends between the portions 40, 42 which are attached to the ends 26, 30 of the core 24. This side portion 52, 52*a*, 52*b* has a length that is approximately equal to the length of the core 24 when the core 24 is expanded. The side portion 52, 52*a*, 52*b* folds around the edges 47 of the core 24 along fold lines 54, 54*a*, 54*b* and 55, 55*a*, 55*b* of the type described hereinabove. The side portion 52, 52*a*, 52*b* is divided at approximately its midpoint into two generally equal portions 56, 56*a*, 56*b* and 58, 58*a*, 58*b* by a fold line 60, 60*a*, 60*b*, which is preferably formed by a scoring bead or an integrally formed score indentation, as described hereinabove, which extends along the width of the deck sheet 22, 22*a*, 22*b*.

The fold line or score indentation 60, 60*a*, 60*b* allows the deck sheet 22, 22*a*, 22*b* to be easily folded outwardly by a user to collapse the roll riser 20, 20*a*, 20*b* for shipment to a user or for storage. However, even without action by the user, the natural tendency of the fold lines 54, 55; 54*a*, 55*a* and 55*b*, 55*b* is to expand the roll riser 20, 20*a*, 20*b* outwardly. Thus, the scored fold lines, in combination with the natural tendency of the honeycomb core 24 to collapse, acts to urge the roll riser 20, 20*a*, 20*b* into a collapsed configuration.

In order to remedy the roll riser's 20, 20*a*, 20*b* natural tendency to collapse, the present invention discloses novel solutions. The first end portion 44, 44*a*, 44*b* and the second end portion 46, 46*a*, 46*b* of the deck sheet 22, 22*a*, 22*b*, respectively, are folded against the core 24 to counteract the roll riser's 20, 20*a*, 20*b* natural tendency to collapse.

Figure 9:
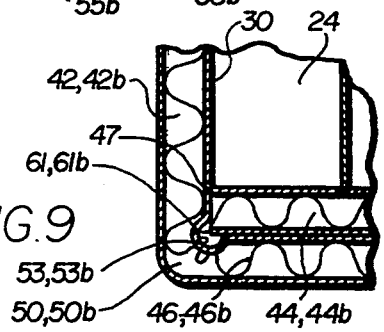
FIG. 9 is a cross-sectional view of a corner section of the roll riser taken along line 9—9 in FIGS. 3 and 7.

In a first embodiment which incorporates the features of the present invention, as shown in FIGS. 1–3, when the first end portion 44 and the second end portion 46 are folded against the expanded core 26, the end portions 44, 46 extend along substantially the entire length of the expanded core 24. The first end portion 44 is folded around its fold line 48 and lies adjacent to and generally abuts the side 36 of the core 24 when the core 24 is fully expanded. The second end portion 46 is then folded around its fold line 50 and overlaps the first end portion 44. When in the overlapping position, the second end portion 46 lies generally adjacent to and abuts the first end portion 44. As shown in FIG. 9, the fold line 50 of the second end portion 46 will be offset from the edge 47 of the core 24 approximately a distance which is equal to the thickness of the first end portion 44 of the deck sheet 22 to provide clearance for the first end portion 44 so that the second end portion 46 will lie in a flat, abutting relationship with the first end portion 44. A terminal end on edge 61, 61*b* of the portion 46, 46*b* is wedged into the corner defined, in part, by the score line indentation 53, 53*b*, whereby the panel portion 44, 44*b* is effectively locked in its folded position until a user manually unfolds the portion 46, 46*b*.

In a second embodiment which incorporates the features of the present invention, as shown in FIGS. 4 and 5, when the first end portion 44*a* and the second end portion 46*a* are folded against the expanded core 24, the end portions 44*a*, 46*a* extend a predetermined distance along the length of the expanded core 24. The first and second end portions 44*a*, 46*a* are folded around their fold lines 48*a*, 50*a*, respectively, and lie adjacent to and generally abut the side 34 of the core 24 when the core 24 is fully expanded. Preferably, the first and second end portions 44*a*, 46*a* extend to approximately the midpoint of the length of the core 24 and lie flush with respect to each other. The ends 62 of the end portions 44*a*, 46*a* generally abut each other and the core 24 is completely enclosed within the deck sheet 22*a*. While these are the preferred lengths for the end portions 44*a*, 46*a*, it is to be understood that it is within the scope of this embodiment that the first and second end sheets may overlap each other a predetermined distance.

In a third embodiment which incorporates the features of the present invention, as shown in FIGS. 6 and 7, when the first end portion 44*b* and the second end portion 46*b* are folded against the expanded core 24, the first end portion 44*b* extends substantially the entire length of the expanded core 24 and the second end portion 46*b* extends only a partial distance along the length of the expanded core 24. The first end portion 44*b* is folded around its fold line 48*b* and lies adjacent to and generally abuts the side 36 of the core 24 when the core 24 is fully expanded. The second end portion 46*b* is then folded around its fold line 50*b* and overlaps the first end portion 44*b*. When in the overlapping position, the second end portion 46*b* lies generally adjacent to and abuts the first end portion 44*b*. In a manner similar to that of the first embodiment, and as shown in FIG. 9, the fold line 50*b* of the second end portion 46*b* will be offset from the edge 47 of the core 24 approximately a distance which is equal to the thickness of the first end portion 44*b* so as to provide clearance for the first deck sheet 44*b* so that the second end portion 46*b* will lie in a flat, abutting relationship with the first end portion 44*b*.

Preferably, and as shown in FIGS. 6 and 7, the second end portion 46*b* extends to approximately the midpoint of the length of the expanded core 24. However, it is to be understood that the second end portion 46*b* may extend a distance which is greater or less than the midpoint.

When the roll riser 20, 20*a*, 20*b* is in its collapsed, generally flat configuration, as shown in FIGS. 1, 4 and 6, the side portion 52, 52*a*, 52*b* of the deck sheet 22, 22*a*, 22*b* is collapsed about its fold lines 54, 55; 54*a*, 55*a* and 55*b*, 55*b* and 60, 60*a*, 60*b*, and the core 24 is collapsed. To expand the roll riser 20, 20*a*, 20*b*, the user pulls the opposing side or end portions 40, 40*a*, 40*b* and 42, 42*a*, 42*b* away from each other. As the roll riser 20, 20*a*, 20*b* expands, the side portion 52, 52*a*, 52*b* moves inwardly toward the core 24. When the roll riser 20, 20*a*, 20*b* is fully expanded, the side portion 52, 52*a*, 52*b* generally abuts the side 34 of the core 24. The first end portion 44, 44*a*, 44*b* and the second end portion 46, 46*a*, 46*b* are folded against the core 24 as described hereinabove. When the end portions 44, 44*a*, 44*b* and 46, 46*a*, 46*b* are folded against the core 24, the roll riser 20, 20*a*, 20*b* remains in an expanded configuration. This occurs, in part, because the end portions 44, 44*a*, 44*b* and 46, 46*a*, 46*b*, when folded against the side 36 of the core 24, do not provide a fold line, similar to that of the side portion 52, 52*a*, 52*b* fold line 60, 60*a*, 60*b*, around which the roll riser 20, 20*a*, 20*b* can collapse. Furthermore, when the device or roll riser is placed with the side 52, 52*a*, 52*b* down, the weight of the device restrains the side from bending or springing back toward a collapsed condition. Thus, the outwardly expanding force created by the fold lines 54, 55; 54*a*, 55*a* and 55*b*, 55*b* on the side portion 52, 52*a*, 52*b* is insufficient and the core 24 cannot collapse, and the roll riser 20, 20*a*, 20*b* remains expanded.

In use, the roll riser 20, 20*a*, 20*b* is placed against or beneath a roll of paper (not shown), with the side portion 52 or the folded end portions 44, 44*a*, 44*b* and 46, 46*a*, 46*b* abutting the paper roll. The forces created by the load of paper rolls during transport is resisted by the roll riser 20, 20*a*, 20*b* so the paper rolls are stabilized during shipment. Shipping loads can be distributed across multiple paper rolls when using roll risers.

The roll riser 20, 20*a*, 20*b* of the present invention can be assembled and disassembled easily and quickly. Thus, no specialized training is necessary. Furthermore, the roll riser 20, 20*a*, 20*b* can be reused simply by collapsing and expanding the roll riser 20, 20*a*, 20*b* as described above.

While preferred embodiments of the present invention are shown and described, it is envisioned that those skilled in the art may devise various modifications of the present invention without departing from the spirit and scope of the appended claims. The invention is not intended to be limited by the foregoing disclosure but in accordance with the appended claims, may be practiced otherwise than as specifically described herein.

The invention claimed is:

1. A collapsible and expandable support device capable of attaining collapsed and expanded configurations, comprising:

a sheet member folded upon itself so as to define two sheet portions connected together at a first end portion thereof by first fold line means, and having two free unattached ends at a second end portion thereof;

a collapsible and expandable core having end portions thereof fixedly secured to oppositely disposed interior surface portions of said two sheet portions at positions intermediate said first and second end portions of said folded sheet member so as to separate said first end portion, comprising two sheet sections connected together by said first fold line means, from said second end portion comprising two unattached sheet sections; and also having two side portions; and second and third fold line means for respectively connecting said two sheet sections of said first end portion of said sheet member to said collapsible and expandable core, and said two unattached sheet sections of said second end portion of said sheet member to said collapsible and expandable core, such that when said collapsible and expandable core is collapsed, said first fold line means and said two free unattached ends of said sheet member are disposed remote from said side portions of said collapsible and expandable core, whereas when said collapsible and expandable core is expanded, said second fold line means permit said two sheet sections and said first fold line means of said first end portion of said sheet member to be folded into engagement with a first one of said two side portions of said collapsible and expandable core, and said third fold line means permit said two unattached sheet sections of said second end portion of said sheet member to be folded into engagement with a second one of said two side portions of said collapsible and expandable core whereby said collapsible and expandable support device is retained in its expanded configuration.

2. A device as defined in claim 1, wherein said first, second, and third fold line means are integrally formed score indentations.

3. A device as defined in claim 1, wherein:

said collapsible and expandable core has a predetermined length when said collapsible and expandable core is disposed in its expanded configuration; and a first one of said two unattached sheet sections of said second end portion extends along substantially the entire length of said collapsible and expandable core when said core is disposed in said expanded configuration, and a second one of said two unattached sheet sections of said second end portion folds over said first one of said two unattached sheet sections of said second end portion along a fold line of said third fold line means so as to extend a predetermined distance along said length of said core when said core is disposed in said expanded configuration.

4. A device as defined in claim 3, wherein:

said second one of said two unattached sheet sections of said second end portion extends along substantially the entire length of said collapsible and expandable core when said collapsible and expandable core is disposed in said expanded configuration.

5. A device as defined in claim 3, wherein said first, second, and third fold line means are integrally formed score indentations.

6. A device as defined in claim 3, wherein:

said second one of said two unattached sheets sections of said second end portion extends to approximately the midpoint of said collapsible and expandable core along said predetermined length thereof when said collapsible and expandable core is disposed in said expanded configuration.

7. A device as defined in claim 3, wherein:

an end edge of said first one of said two unattached sheet sections of said second end portion is wedged substantially against said fold line of said second one of said two unattached sheet sections of said second end portion when said collapsible and expandable core is disposed in said expanded configuration for aiding in maintaining said device in said expanded configuration.

8. A device as defined in claim 1, wherein:

each of said two unattached sheet sections of said second end portion extends a predetermined distance along said core and abut said second one of said two side portions of said collapsible and expandable core when said collapsible and expandable core is disposed in said expanded configuration.

9. A device as defined in claim 8, wherein:

each one of said two unattached sheet sections of said second end portion extends to approximately the midpoint of said collapsible and expandable core when said collapsible and expandable core is disposed in said expanded configuration.

10. A device as defined in claim 1, wherein said core comprises an open-celled construction.

11. A device as set forth in claim 1, wherein:

said collapsible and expandable core has a predetermined length when said collapsible and expandable core is disposed in its expanded configuration; and at least one of said two unattached sheet sections of said second end portion of said sheet member folded into engagement with said second one of said two side portions of said collapsible and expandable core has a predetermined length which is substantially equal to said predetermined length of said collapsible and expandable core when said collapsible and expandable core is disposed in said expanded configuration.

12. A device as set forth in claim 11, wherein:

said two sheet sections of said first end portion of said sheet member together have a predetermined length which is substantially equal to said predetermined length of said collapsible and expandable core when said collapsible and expandable core is disposed in said expanded configuration.

13. A device as defined in claim 12, wherein said first, second, and third fold line means are integrally formed score indentations.

14. The device as set forth in claim 1, wherein:

said device comprises a roll riser for staggering paper rolls during shipment.

15. The device as set forth in claim 1, wherein:

said sheet member is fabricated from corrugated cardboard.

* * * * *